US010987601B2

(12) United States Patent
McDonald et al.

(10) Patent No.: US 10,987,601 B2
(45) **Date of Patent: *Apr. 27, 2021**

(54) ASSEMBLY WITH INNER OBJECT IN HOUSING THAT BREAKS OUT OF HOUSING

(71) Applicant: Spin Master Ltd., Toronto (CA)

(72) Inventors: David Lewis McDonald, Mississauga (CA); Amy Anne Pruzansky, Toronto (CA)

(73) Assignee: Spin Master Ltd., Toronto (CA)

( * ) Notice: Subject to any disclaimer, the term of this patent is extended or adjusted under 35 U.S.C. 154(b) by 0 days.

This patent is subject to a terminal disclaimer.

(21) Appl. No.: 16/903,957

(22) Filed: Jun. 17, 2020

(65) Prior Publication Data

US 2020/0316484 A1 Oct. 8, 2020

Related U.S. Application Data

(63) Continuation of application No. 15/824,855, filed on Nov. 28, 2017, now Pat. No. 10,717,016.

(51) Int. Cl.

| | |
|---|---|
| ***A63H 13/03*** | (2006.01) |
| ***A63H 29/22*** | (2006.01) |
| ***A63H 3/18*** | (2006.01) |
| ***A63H 3/50*** | (2006.01) |
| ***A63H 3/52*** | (2006.01) |

(Continued)

(52) U.S. Cl.

CPC ..... *A63H 13/03* (2013.01); *A63H 3/18* (2013.01); *A63H 3/50* (2013.01); *A63H 3/52* (2013.01); *A63H 11/00* (2013.01); *A63H 29/22* (2013.01); *A63H 3/36* (2013.01); *A63H 13/02* (2013.01); *A63H 13/16* (2013.01)

(58) Field of Classification Search

CPC ..... A63H 13/03; A63H 13/16; A63H 29/22; A63H 13/02; A63H 3/36; A63H 3/50; A63H 3/52; A63H 11/00

USPC ..... 446/310, 311

See application file for complete search history.

(56) References Cited

U.S. PATENT DOCUMENTS 608,794 A 8/1898 Quinn
685,345 A 10/1901 Perkins et al.

(Continued)

FOREIGN PATENT DOCUMENTS

CN 2135170 Y 6/1993
CN 2299836 Y 12/1998

(Continued)

OTHER PUBLICATIONS

U.S. Appl. No. 15/199,341, Non-Final Office Action, USPTO, dated Jun. 20, 2018.

(Continued)

*Primary Examiner* — Joseph B Baldori
(74) *Attorney, Agent, or Firm* — Millman IP Inc.

(57) ABSTRACT

In an aspect, a toy assembly is provided, and includes a housing, an inner object (which may, in some embodiments, be a toy character) inside the housing, a tether, and a breakout motor. The tether connects the inner object to the housing. The breakout motor is operatively connected to a portion of the inner object to drive the inner object to carry out movement inside the housing. The movement of the inner object inside the housing drives the tether to open a hole in the housing.

11 Claims, 14 Drawing Sheets

(51) Int. Cl.

| | |
|---|---|
| ***A63H 11/00*** | (2006.01) |
| ***A63H 13/02*** | (2006.01) |
| ***A63H 3/36*** | (2006.01) |
| ***A63H 13/16*** | (2006.01) |

(56) References Cited

U.S. PATENT DOCUMENTS

| | | | | |
|---|---|---|---|---|
| 722,731 | A | 3/1903 | Mackaye | |
| 1,237,954 | A | 8/1917 | Prevost | |
| 3,005,284 | A | 10/1961 | Angelo | |
| 3,091,053 | A | 5/1963 | Growald | |
| 3,300,118 | A * | 1/1967 | Owens | B65D 3/263 229/201 |
| 4,091,929 | A * | 5/1978 | Krane | B65D 3/263 229/101.1 |
| 4,194,318 | A * | 3/1980 | Watanabe | A63H 17/00 446/270 |
| 4,237,648 | A | 12/1980 | Goldfarb | |
| 4,259,805 | A | 4/1981 | Hornsby, Jr. | |
| D276,705 | S | 12/1984 | Oliveri | |
| 4,575,348 | A * | 3/1986 | Wiggs | A63H 13/16 446/310 |
| 4,591,345 | A | 5/1986 | Kohner | |
| 4,698,043 | A * | 10/1987 | May | A63H 33/005 446/273 |
| 4,736,943 | A | 4/1988 | Fukuda | |
| 4,758,198 | A * | 7/1988 | Ishiwa | A63H 3/06 137/512 |
| 4,773,541 | A * | 9/1988 | Riddell | B65D 3/263 229/235 |
| 4,817,936 | A | 4/1989 | Matsuda | |
| 4,836,821 | A | 6/1989 | Raymond | |
| 4,881,915 | A | 11/1989 | Liaw | |
| D308,938 | S | 7/1990 | Van Erkel | |
| D312,845 | S | 12/1990 | Matsuda | |
| D318,240 | S | 7/1991 | Pang | |
| 5,120,263 | A * | 6/1992 | Ierfino | A63H 37/00 273/459 |
| 5,263,889 | A * | 11/1993 | Ledonne | A63H 33/00 206/526 |
| 5,451,180 | A * | 9/1995 | Chan | A63H 13/00 40/411 |
| 5,522,758 | A * | 6/1996 | Liu | A63H 13/00 40/411 |
| 5,795,209 | A | 8/1998 | Moore | |
| 5,813,895 | A | 9/1998 | Cho | |
| D406,053 | S | 2/1999 | Ying | |
| 5,989,092 | A | 11/1999 | McGowan | |
| 6,171,166 | B1 * | 1/2001 | Oquita | A63F 11/0011 383/119 |
| 6,210,250 | B1 * | 4/2001 | Sui | A63H 13/00 40/415 |
| D442,650 | S | 5/2001 | Allen | |
| 6,231,346 | B1 | 5/2001 | Sagi-Dolev | |
| 6,250,985 | B1 | 6/2001 | Nicholson | |
| 6,312,308 | B1 * | 11/2001 | Chen | A47G 33/06 40/410 |
| 6,592,426 | B2 | 7/2003 | Mesch | |
| D478,134 | S | 8/2003 | Yuan | |
| 6,648,713 | B1 * | 11/2003 | Oquita | A63H 37/00 446/487 |
| 6,702,644 | B1 | 3/2004 | Hornsby | |
| 6,761,612 | B1 * | 7/2004 | Pencil | A63H 13/16 40/411 |
| D532,463 | S | 11/2006 | Boutin | |
| 8,684,224 | B2 * | 4/2014 | House | B65D 3/265 220/677 |
| 8,974,264 | B2 * | 3/2015 | McCafferty | A63H 13/16 446/429 |
| 9,550,128 | B1 | 1/2017 | Pruzansky et al. | |
| D789,241 | S | 6/2017 | Cao | |
| 9,720,378 | B2 * | 8/2017 | Hills | G04F 1/005 |
| 9,724,616 | B1 * | 8/2017 | Pedersen | A63H 27/10 |
| D801,621 | S | 11/2017 | Ensslen | |
| 10,717,016 | B2 * | 7/2020 | McDonald | A63H 3/50 |
| 2001/0034178 | A1 | 10/2001 | Spector | |
| 2004/0127140 | A1 | 7/2004 | Kelly et al. | |
| 2005/0075041 | A1 | 4/2005 | Norman | |
| 2006/0030236 | A1 | 2/2006 | Ueno et al. | |
| 2007/0049162 | A1 * | 3/2007 | Liao | A63H 13/02 446/487 |
| 2007/0102308 | A1 | 5/2007 | Tremblay et al. | |
| 2007/0173170 | A1 | 7/2007 | Wu | |
| 2008/0014831 | A1 | 1/2008 | Rettberg et al. | |

FOREIGN PATENT DOCUMENTS

| | | | |
|---|---|---|---|
| CN | 2313646 | Y | 4/1999 |
| CN | 2750846 | Y | 1/2006 |
| CN | 2834651 | Y | 11/2006 |
| CN | 102475981 | A | 5/2012 |
| CN | 202478611 | U | 10/2012 |
| CN | 103160098 | A | 6/2013 |
| EP | 206500 | A1 | 12/1986 |
| EP | 420386 | A1 | 3/1991 |
| FR | 1164900 | A | 10/1958 |
| FR | 2 554 360 | A1 | 5/1985 |
| GB | 2189710 | A | 11/1987 |
| GB | 2355940 | A | 5/2001 |
| GB | 2367766 | A | 4/2002 |
| GB | 2537604 | A | 10/2016 |
| GB | 2538604 | A | 10/2016 |
| JP | S48-14427 | B | 5/1973 |
| JP | S61-87225 | U | 12/1987 |
| JP | H02252482 | A | 10/1990 |
| JP | 02-141495 | U | 11/1990 |
| JP | 03-007886 | U | 1/1991 |
| JP | H02-141495 | U1 | 11/1991 |
| JP | 10-286382 | A | 10/1998 |
| JP | 2002-224463 | A | 8/2002 |
| JP | 2004-035829 | A | 2/2004 |
| JP | 2009095283 | A | 5/2009 |
| JP | 2012 157565 | A | 8/2012 |
| KR | 10-2002-0062182 | A | 7/2002 |
| KR | 200386793 | Y1 | 6/2005 |
| WO | 2004041388 | A1 | 5/2004 |
| WO | 2010045268 | A2 | 4/2010 |

OTHER PUBLICATIONS

Mitsuishi, K. et al., "Mechanical properties of polyethylene/ethylene vinyl acetate tilled with calcium carbonate", Polymer Composites (Impact Factor: 1.63). Apr. 1988; 9(2). DOI: 10.1002/pc.750090203, abstract accessed Jan. 29, 2016.

U.S. Appl. No. 14/884,191, Non-Final Office Action, dated Oct. 28, 2016, USPTO.

EP 16193072.2, Partial European Search Report, European Patent Office dated Jun. 22, 2017.

JP 2016-253210, Japanese Office Action and English Translation, Japanese Patent Office Jun. 6, 2017.

EP 19210345.5. Extended European Search Report, European Patent Office dated Nov. 13, 2020.

ZL201720006260.9, Utility Model Patent Evaluation Report, Chinese State Intellectual Property Office, Sep. 11, 2017.

ZL201621220601.4, Utility Model Patent Evaluation Report, Chinese State Intellectual Property Office, Sep. 11, 2017.

CN2016109010760, Search Report, Chinese State Intellectual Property Office, dated May 17, 2018.

U.S. Appl. No. 15/935,280, Non-Final Office Action, USPTO, May 25, 2018.

EP 17207495.7, European Search Report, European Patent Office, dated May 23, 2018.

EP17199571.5, Partial European Search Report, dated Oct. 26, 2018, European Patent Office.

EP17199604.4, European Search Report, dated Oct. 26, 2018, European Patent Office.

AU2017219164, Examination Report, Oct. 31, 2018, IP Australia.

(56) References Cited

OTHER PUBLICATIONS

EP17199604.4, European Examination Report, Nov. 26, 2018, European Patent Office.
KR10-2018-935634, Office Action, dated Nov. 17, 2018, Korean Intellectual Property Office.
EP 17199571.5, Article 94(3) EPC Communication, Mar. 13, 2019, European Patent Office.
CN 2016109010760, Office Action & English machine translation, dated Dec. 25, 2018, China National Intellectual Property Administration.
Li et al., Product Design Engineering, Nov. 30, 2014.
JP 2018-072842, Office Action & English translation thereof, dated May 28, 2019, Japanese Patent Office.
EP 18164055.8, European Search Report, dated Jun. 6, 2019, European Patent Office.

* cited by examiner

ASSEMBLY WITH INNER OBJECT IN HOUSING THAT BREAKS OUT OF HOUSING

CROSS-REFERENCE TO RELATED APPLICATIONS

This application is a continuation of U.S. patent application Ser. No. 15/824,855, filed Nov. 28, 2017, the contents of which are incorporated herein by reference in their entirety.

FIELD

The specification relates generally to assemblies with inner objects that break out of housings.

BACKGROUND OF THE DISCLOSURE

There is a market desire for toys wherein there is some element of surprise in terms of what toy a user will end up with upon purchase. An example of such a toy is the Hatchimals line of products made and sold by Spin Master Ltd. There is also a desire for toys that release themselves from the housings in which they reside, which in some instances lends an air of reality to the toy, whether or not the user knows which toy they are getting.

SUMMARY OF THE DISCLOSURE

In an aspect, a toy assembly is provided, and includes a housing, an inner object (which may, in some embodiments, be a toy character) inside the housing, a tether, and a breakout motor. The tether connects the inner object to the housing. The breakout motor is operatively connected to a portion of the inner object to drive the inner object to carry out movement inside the housing. The movement of the inner object inside the housing drives the tether to open a hole in the housing.

In another aspect, a toy assembly is provided, and includes a housing, an inner object inside the housing, a tether connecting the inner object to the housing, and a breakout drive shaft that is operatively connected to a portion of the inner object to drive the inner object to carry out movement inside the housing. The movement of the inner object inside the housing drives the tether to open a hole in the housing.

BRIEF DESCRIPTIONS OF THE DRAWINGS

For a better understanding of the various embodiments described herein and to show more clearly how they may be carried into effect, reference will now be made, by way of example only, to the accompanying drawings in which.

DETAILED DESCRIPTION

Figure 1:
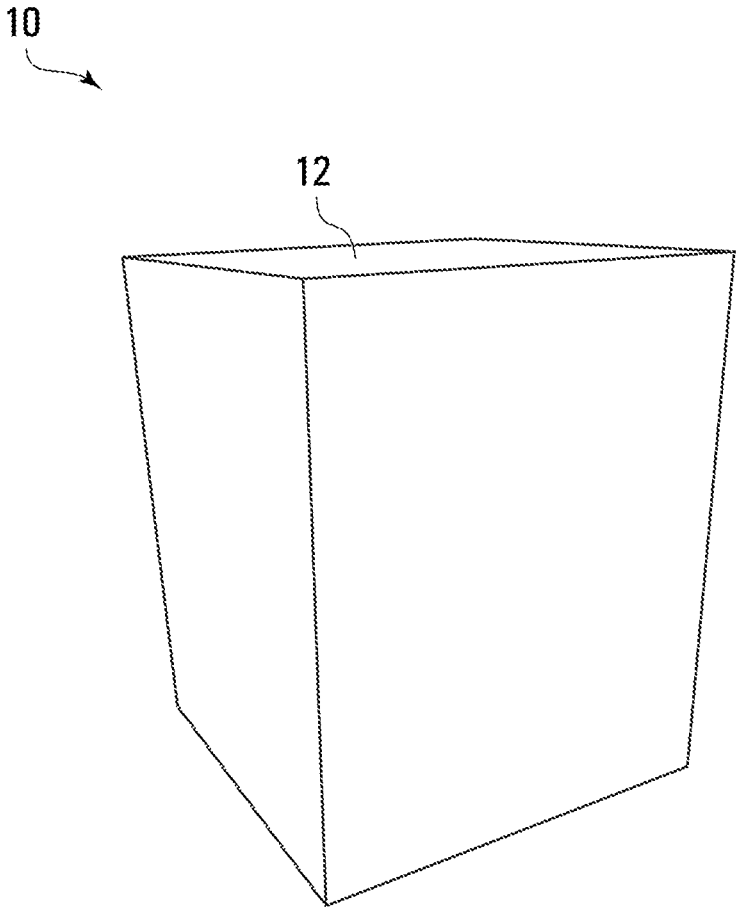
FIG. 1 is a perspective view of a toy assembly according to a non-limiting embodiment.
Figure 2:
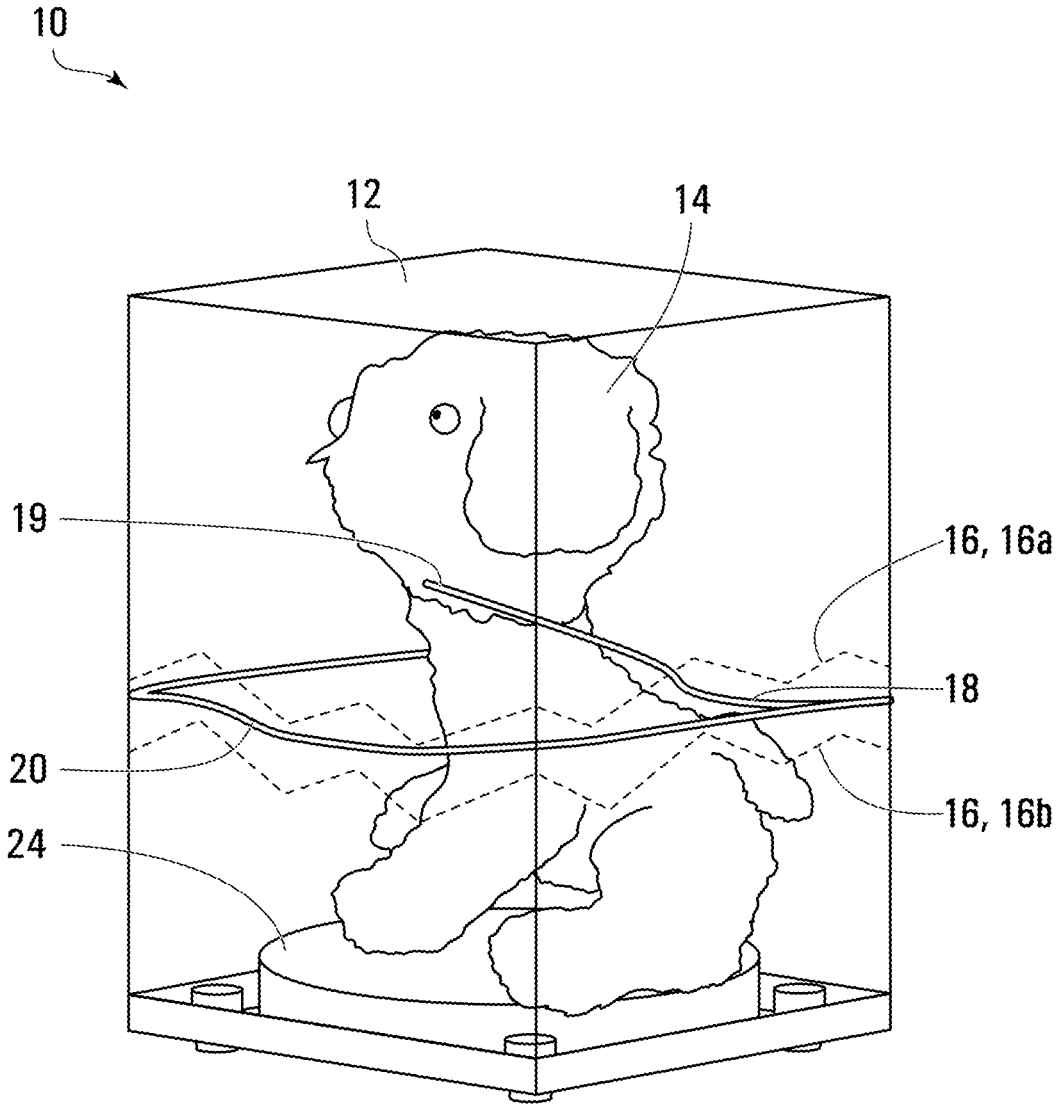
FIG. 2 is a perspective, transparent view of the toy assembly shown in FIG. 1, illustrating a housing and a toy character inside the housing in a sitting position.

Reference is made to FIGS. 1 and 2, which show a toy assembly 10 in accordance with an embodiment of the present disclosure. The toy assembly 10 includes a housing 12 and an inner object 14 (FIG. 2) that is positioned in the housing 12, and which is configured to break the housing 12 from within the housing 12. The housing 12 in FIG. 2 is shown for convenience as being transparent, so as to show the inner object 14 therein. The housing 12 may be opaque, however, as shown in FIG. 1 so as to prevent the purchaser of the toy assembly 10 from knowing which version of the inner object 14 they will get. It will be understood, however, that in some alternative embodiments, the housing 12 could be translucent or transparent, or could have one or more translucent or transparent sections in other embodiments. As another alternative, in some embodiments the housing 12 could alternatively only partially enclose the inner object 14 so that the inner object 14 could be visible from some angles even when it is inside the housing 12.

In the embodiment shown, the housing 12 is in the form of a box, and the inner object 14 is a toy character, which, in the present example, is in the form of a puppy. The housing 12 and inner object 14 may have any other suitable shapes. The inner object 14 may be referred to below as a toy character 14 below for greater readability of the present disclosure, however it will be understood that the inner object could have any suitable shape and need not be a toy character.

Figure 6A:
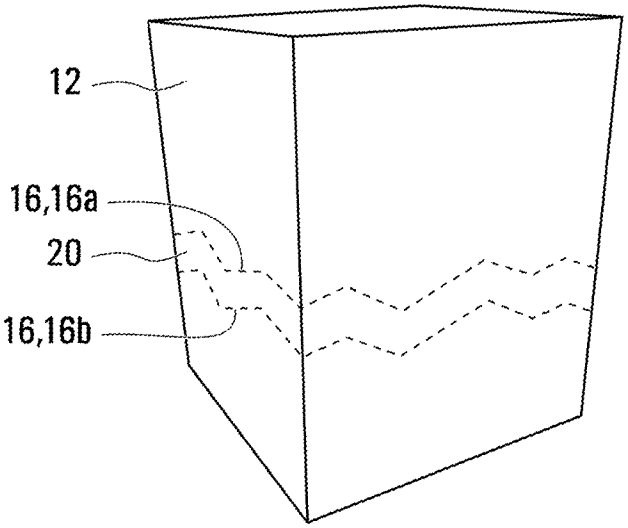
FIGS. 6A, 6B and 6C are perspective views that illustrate progressive tearing of a strip from the housing shown in FIG. 2.

With reference to FIG. 6, the housing 12 may include two preselected, non-linear fracture paths 16 formed therein (individually shown as a first fracture path 16*a* and a second fracture path 16*b*). As a result, when the toy character 14 breaks the housing 14 it appears to the user that the housing 12 has been broken somewhat randomly by the toy character 14, to impart realism to the process of breaking the housing 12. The irregular fracture paths 16 may have any suitable shape. For example, the fracture paths 16 may each have a non-uniform zig-zag shape as shown. In the example shown, the fracture paths 16*a* and 16*b* are generally parallel to one another.

The irregular fracture paths 16 may be formed in any suitable way. For example, the fracture paths 16*a* and 16*b* may be formed by scoring the inside surface of the housing 12 along a selected path in such a way so as not to score all the way through to the exterior surface of the housing 12. Such scoring would weaken the housing 12 along the selected fracture path but would not be visible to the user prior to breakage of the housing 12. The scoring on the inside surface of the housing 12 is represented by dashed lines in FIGS. 2, 6A and 6B. In an alternative embodiment, the fracture paths 16 may each be formed by a sequence of perforations, which are visible from the exterior of the housing 12. Alternatively, the fracture paths 16 may be formed any other suitable way.

Walls of the housing 12 that have the fracture paths 16 may be formed from cardboard or from any other suitable material.

A tether 18 (FIG. 2) connects the toy character 14 to the housing 12, and more particularly to a strip 20 of the housing 12 that extends between the first and second fracture paths 16*a* and 16*b*. The tether 18 may be connected to the toy character in any suitable way, such as by tying off one end of the tether 18 to a collar 19 on a neck region of the toy character 14. Another portion of the tether 18 is connected along a length of the strip 20. A breakout motor 22 is operatively connected to a portion of the toy character 14 to drive the toy character 14 to carry out movement inside the housing 12, wherein such movement inside the housing 12 drives the tether 18 to open a hole in the housing. More particularly, the movement inside the housing 12 causes the toy character 14 to pull the tether 18, which in turn pulls the strip 20 progressively tearing the strip 20 from a remainder of the housing 12 along the first and second fracture paths 16*a* and 16*b*. The breakout motor 22 may be any suitable type of motor such as, for example, an electric motor. Other types of motor may alternatively be used, such as a spring-powered motor. The breakout motor 22 may be a uni-directional motor or it may be bi-directional.

Figure 3:
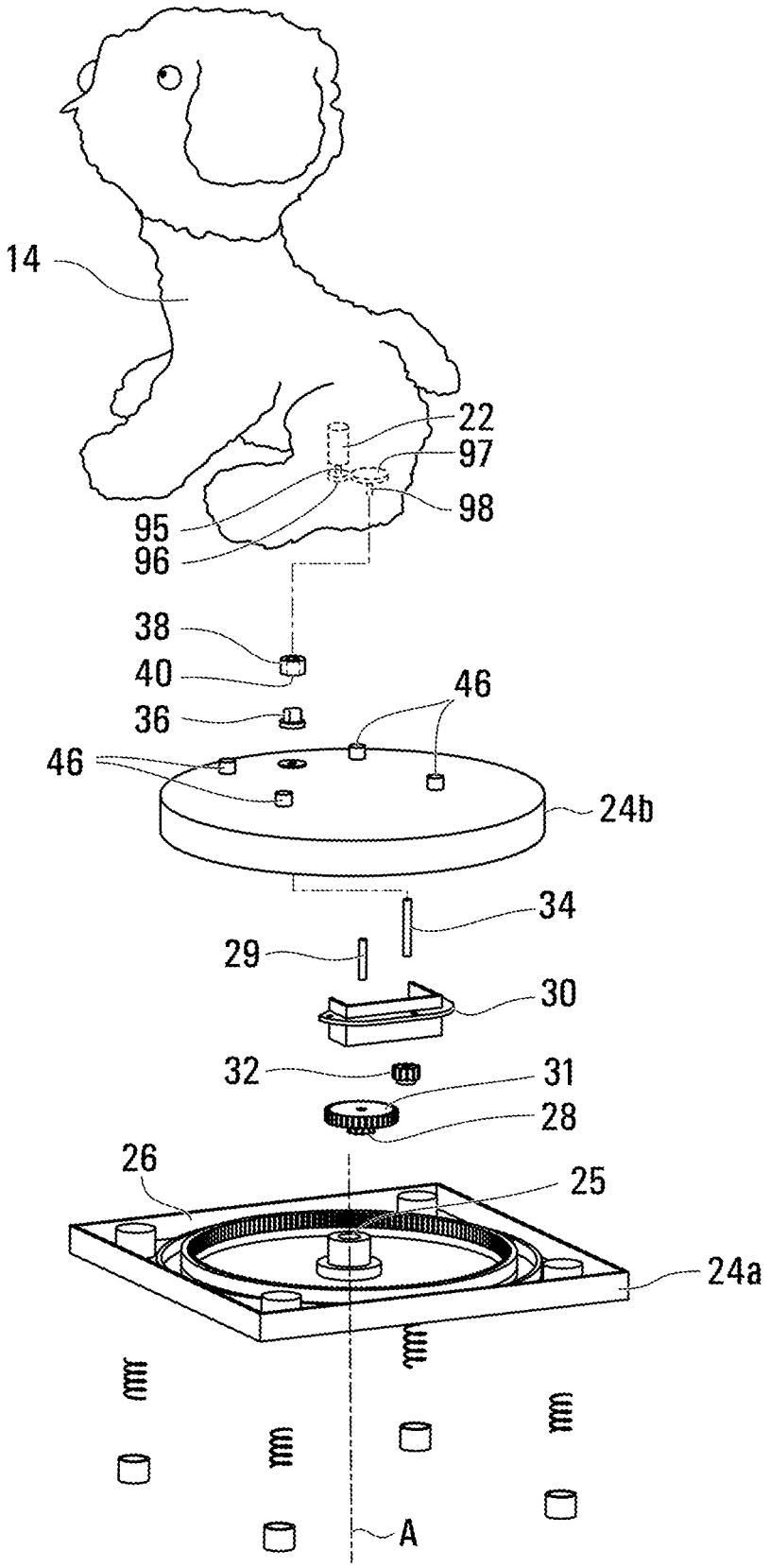
FIG. 3 is a perspective exploded view of most of the toy assembly shown in FIG. 2.
Figure 4A:
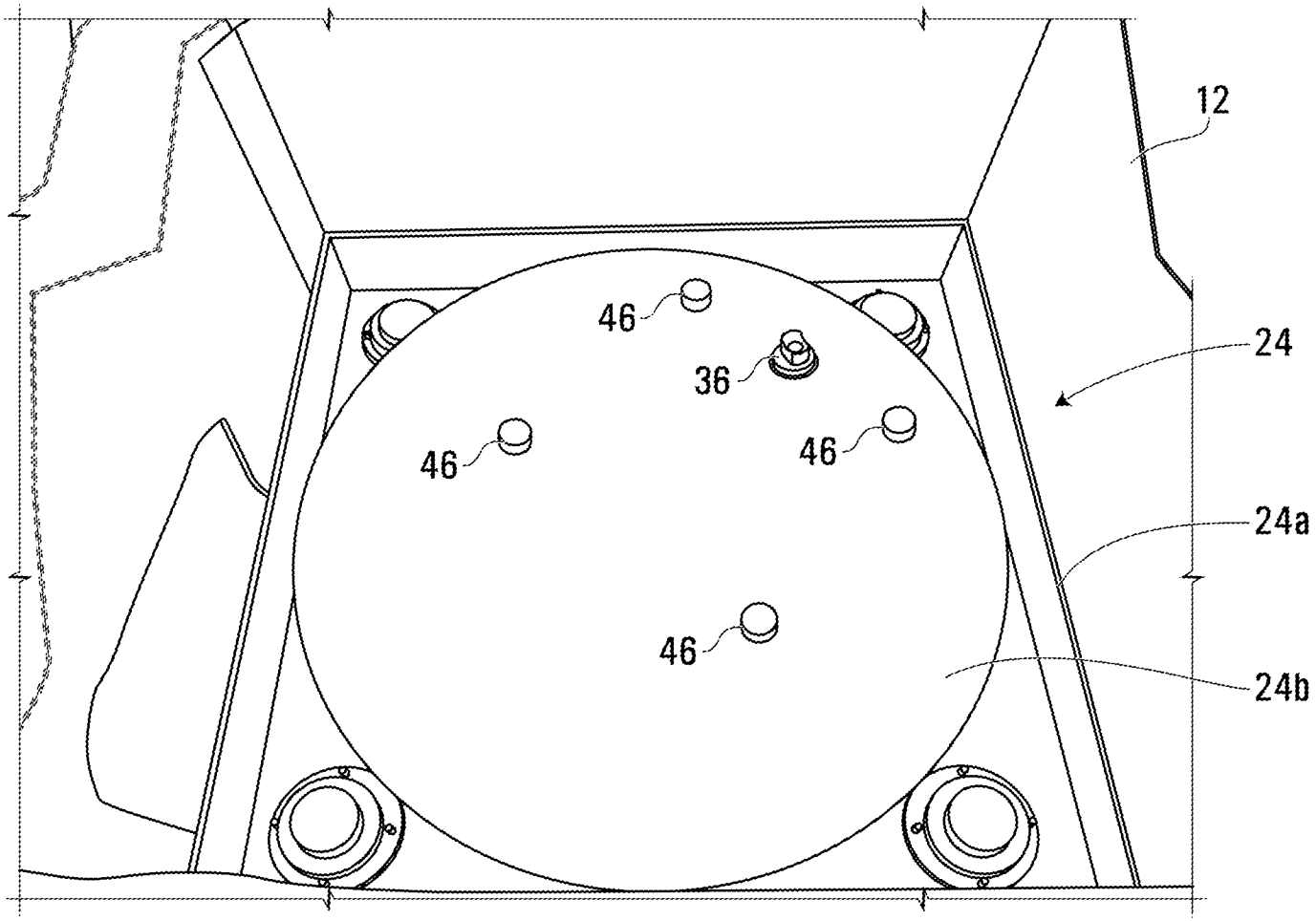
FIG. 4A is a perspective view of a base that is part of the housing shown in FIG. 2, including a first base portion and a second base portion.
Figure 4B:
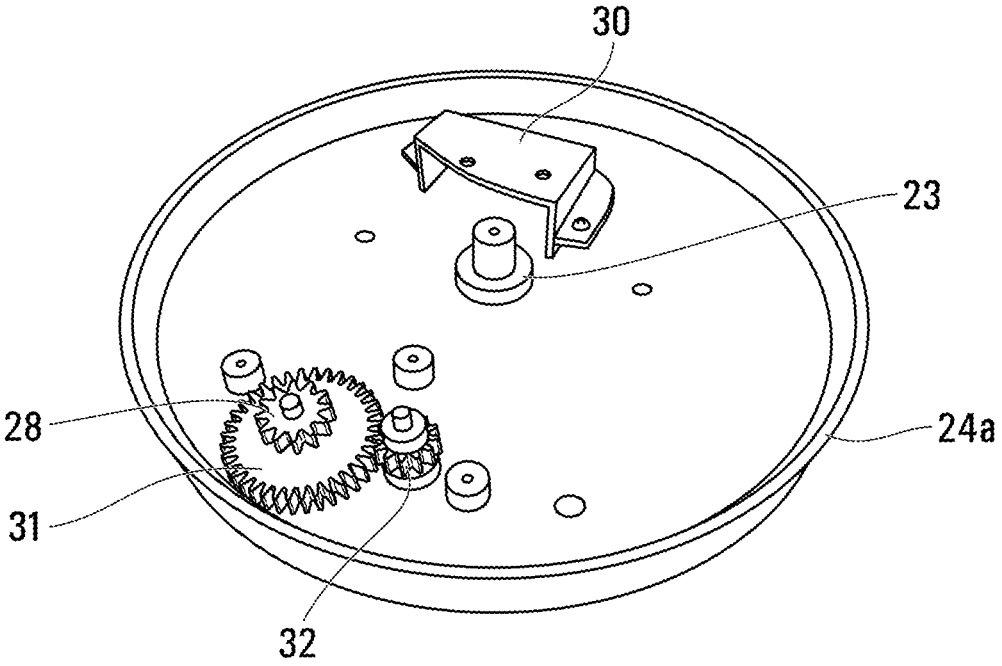
FIG. 4B is a perspective view of the second base portion shown in FIG. 4A.
Figure 4C:
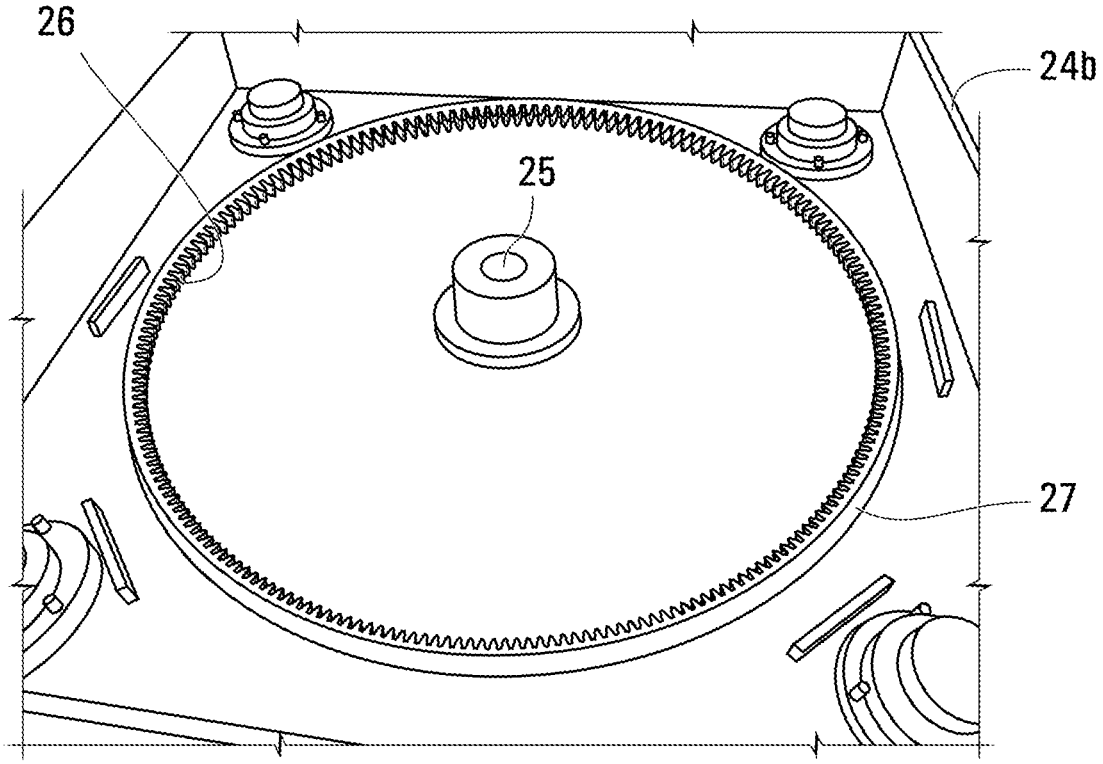
FIG. 4C is a perspective view of the first base portion shown in FIG. 4A.
Figure 5:
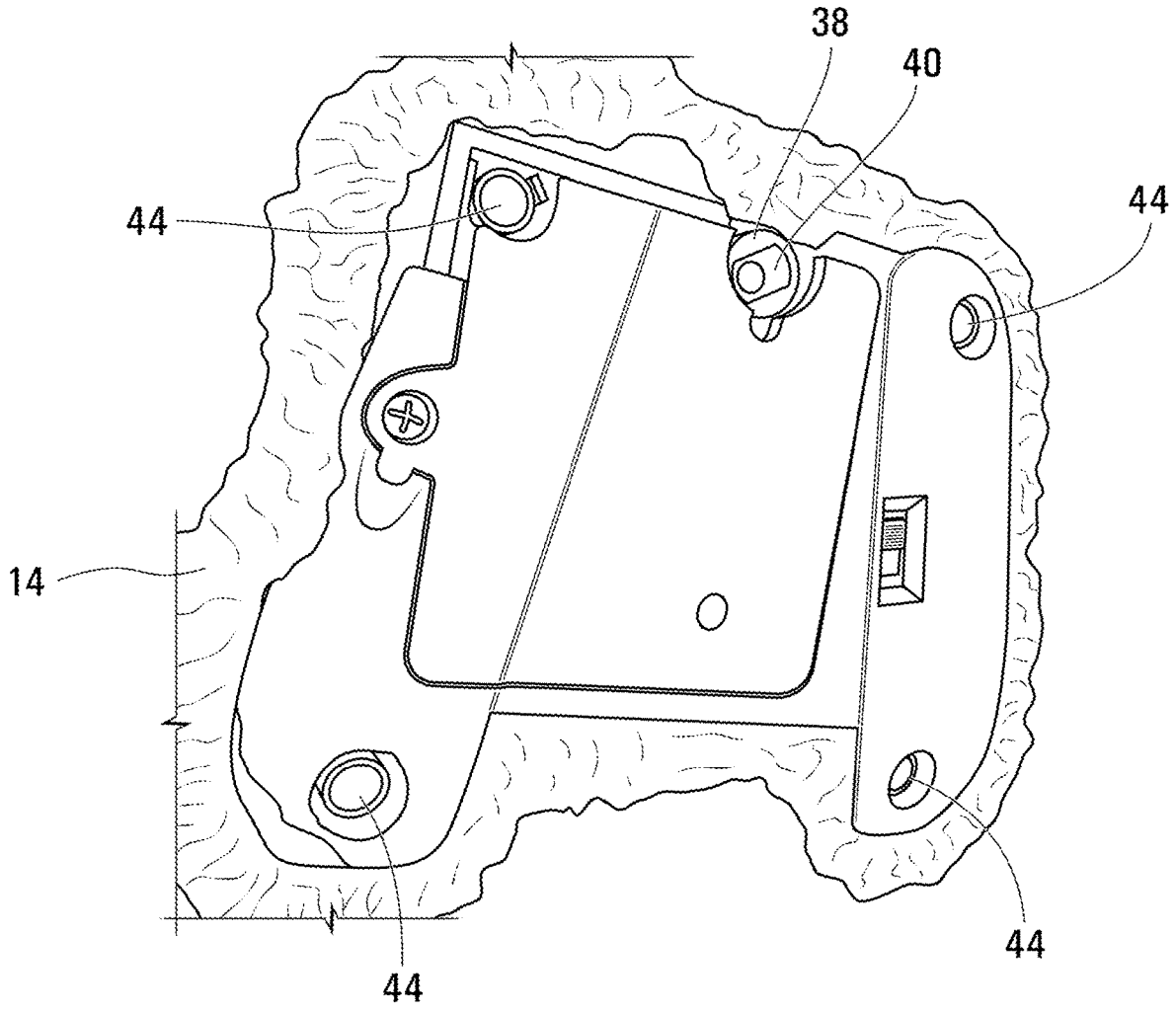
FIG. 5 is a perspective view of an underside of the toy character shown in FIG. 2.

As shown in FIG. 2, in order to carry out the aforementioned movement of the toy character 14 inside the housing, the housing 12 includes a base 24 that supports the toy character 14. An exploded view of the base 24 is shown in FIG. 3. FIG. 4A shows the base assembled. FIGS. 4B and 4C show first and second portions of the base 24 respectively. The base 24 includes a first base portion 24*a* and a second base portion 24*b* that is movably mounted to the first base portion 24*a*. Optionally, the second base portion 24*b* is rotatably mounted to the first base portion 24*a* by way of a base mounting projection 23 on the second base portion 24*b* that is received in a base mounting aperture 25 in the first base portion 24*a*.

The first base portion 24*a* (FIGS. 3 and 4B) has a toothed travel path 26 thereon. In the example shown, the toothed travel path 26 is in the form of a ring gear 27 and is therefore a closed circular path. It is alternatively possible for the toothed travel path to be non-circular. It is alternatively possible for the toothed travel path 26 to be open (i.e. to have a first path end and a second path end).

The toy character 14 is connected to a travel gear 28 (FIGS. 3 and 4C) that is engaged with the toothed travel path 26, such that driving of the breakout motor 22 drives the travel gear 28 to roll along the toothed travel path 26, thereby driving the movement of the toy character 14 inside the housing 12. In the example embodiment, as the travel gear 28 rolls along the circular toothed travel path shown in FIGS. 3 and 4C, the toy character 14 orbits a central axis A of the ring gear 27.

The travel gear 28 may be rotatably connected to the second base portion 24*b*. For example, the travel gear 28 may be fixedly mounted on a travel gear shaft 29 (e.g. by press-fit) that is rotatably mounted between the second base portion 24*b* and a gear guard 30 that is fixedly mounted to the second base portion 24*b*. The gear guard 30 is shown out of place in FIG. 4C so as not to obscure the travel gear 28. Because of the mounting of the second base portion 24*b* to the first base portion 24*a*, the second base portion 24*b* constrains the travel gear 28 to remain engaged with the toothed travel path 26.

The travel gear 28 may be fixedly connected to a first intermediate gear 31 for co-rotation therewith. The first intermediate gear 31 may mesh with a second intermediate gear 32 that is itself also rotatably connected to the second base portion 24*b*. For example, the second intermediate gear 32 may be rotatably mounted to a second intermediate gear shaft 34 that is itself fixedly mounted between the second base portion 24*b* and the gear guard 30.

The second intermediate gear shaft 34 extends through the second base portion 24*b* and has a gear drive projection 36 thereon. The gear drive projection 36 is a non-round projection.

The breakout motor 22 is operatively connected to a toy character output member 38 which has a non-round gear drive aperture 40 thereon, which releasably receives the gear drive projection 36, while the toy character 14 sits on the second base portion 24*b*. In the example shown, the breakout motor 22 is shown in dashed lines as it is provided in the interior of the toy character 14. The breakout motor 22 has an output shaft 95, which drives a first breakout motor gear 96, which is engaged with a second breakout motor gear 97, which itself is on a toy character output shaft 98. The shaft 98 may have the toy character output member 38 thereon. When the breakout motor 22 is driven, the toy character output member 38 is rotated, which drives the gear drive projection 36 to rotate, which in turn drives the intermediate gears 31 and 32 to rotate, which in turn drives the travel gear 28 to rotate and to roll along the toothed travel path 26 provided on the ring gear 27. This causes the second base portion 24*b* to rotate on the first base portion 24*a*. As a result, the toy character 14 travels along a travel path shown at 42 (FIG. 4A) in the housing 12, such that the toy character 14 orbits the central axis A of the ring gear 27.

As the toy character 14 travels along the travel path 42 it pulls the tether 18, which, in turn, pulls the strip 20, so as to open a hole (shown at 48 in FIG. 6C) in the housing 12.

In order to ensure that the toy character 14 does not counterrotate during rotation of the toy character output member 38, the toy character 14 may have a plurality of locating apertures 44, which receive locating projections 46 on the second base portion 24*b*, in order to fix the toy character's orientation relative to the second base portion 24*b*, thereby preventing counterrotation of the toy character 14.

A control system 50 may be provided and includes at least one processor 52 and at least one memory 54, which stores executable code. The at least one processor 52 and the at least one memory 54 may be entirely in the toy character 14. Alternatively some or all of the at least one processor 52 and the at least one memory 54 may be outside the toy character 14, such as, for example, in the housing 12 outside of the toy character 12.

Figure 6B:
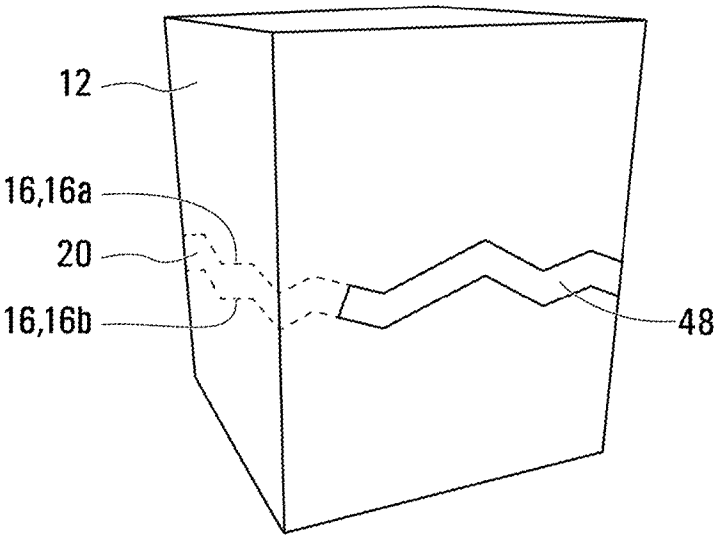
Figure 6C:
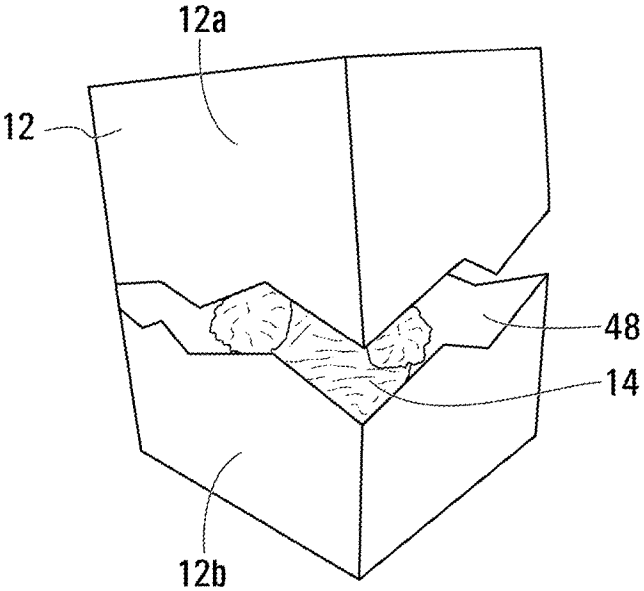

The control system 50 may initiate a breakout operation based on some selected input by a user. The selected input by the user is described later on. Upon receiving the selected input, the control system 50 may be programmed to drive the breakout motor 22 to cause the toy character output member 38 to rotate, which in turn drives the gear drive projection to rotate. The rotation of the gear drive projection 36 drives rotation of the travel gear 28 against the toothed travel path 26, thereby driving travel gear 28 to roll along the travel path 26, bringing the second base portion 24*b* and the toy character 14 therewith. As the toy character 14 moves, it pulls on the tether 18. Because the tether 18 is attached to the strip 20, it pulls the strip 20, and the strip 20 tears from the remaining portion of the housing 12 along the predefined fracture paths 16 if such fracture paths 16 are provided or along a relatively random fracture path if the predefined fracture paths 16 are not provided. Tearing of the strip 20 creates the hole 48 (FIGS. 6B and 6C). The toy character 14 continues to move until the hole 48 is sufficiently large. The hole 48 may be considered to be sufficiently large at any suitable point. In some embodiments, the hole 48 may be sufficiently large when it covers three sides of the housing 12, leaving only one side intact. In other embodiments the hole 48 is considered sufficiently large when the strip 20 has torn all the way around such that a top portion of the housing 12 (shown at 12*a* in FIG. 6*c*) has been separated completely from a bottom portion of the housing 12 (shown at 12*b* in FIG. 6*c*). Once the hole 48 is sufficiently large, the toy character 14 may be removed from the housing 12. In embodiments where some or all of the control system 50 is provided in the toy character 14, the toy character 14 may be capable of interacting with a user (e.g. a child). For example, the toy character 14 may be provided with at least one toy character sensor 63 (FIG. 7) that permits it to receive input from the user or from its ambient environment. For example, the at least one toy character sensor 62 may include a microphone 63 that detects sounds from the user or from its environment. Upon detection of such input, the toy character 14 may respond with output, via a toy character output device. In the embodiment shown, the toy character 14 includes two toy character output devices including a speaker 64 in its mouth region and an animation motor 66 that is connected in such a way as to be rotatable to drive movement of a front portion 14*a* of the toy character 14 relative to a rear portion 14*b* of the toy character 14. The front and rear portions 14*a* and 14*b* of the toy character 14 are shown as simple, linear frame elements that are connected together at pivot joint 14*c* and which are covered by plush material 14*d*. However, any other suitable structure may be provided.

The selected input that is received by the control system 50 so as to initiate the breakout operation may, for example, be a selected sound or a selected plurality of sounds received by the microphone 63 from the user of the toy assembly 10. Alternatively, the selected input may include, for example, pressing a pressure sensor that is embedded on the housing 12 somewhere, and which is connected to the processor 52.

Figure 7:
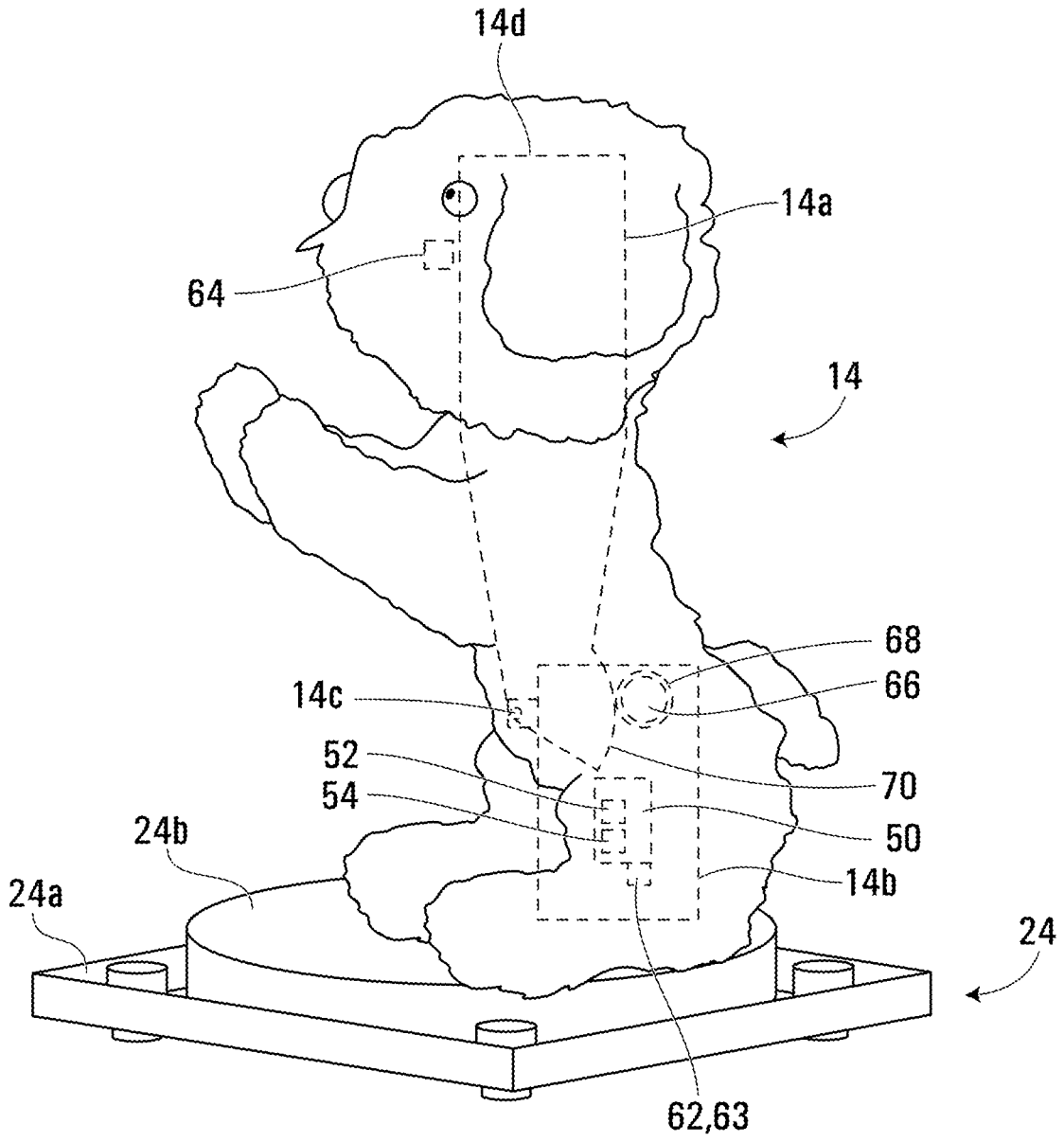
FIG. 7 is a perspective view of the toy character shown in FIG. 2, in an upright position.
Figure 8:
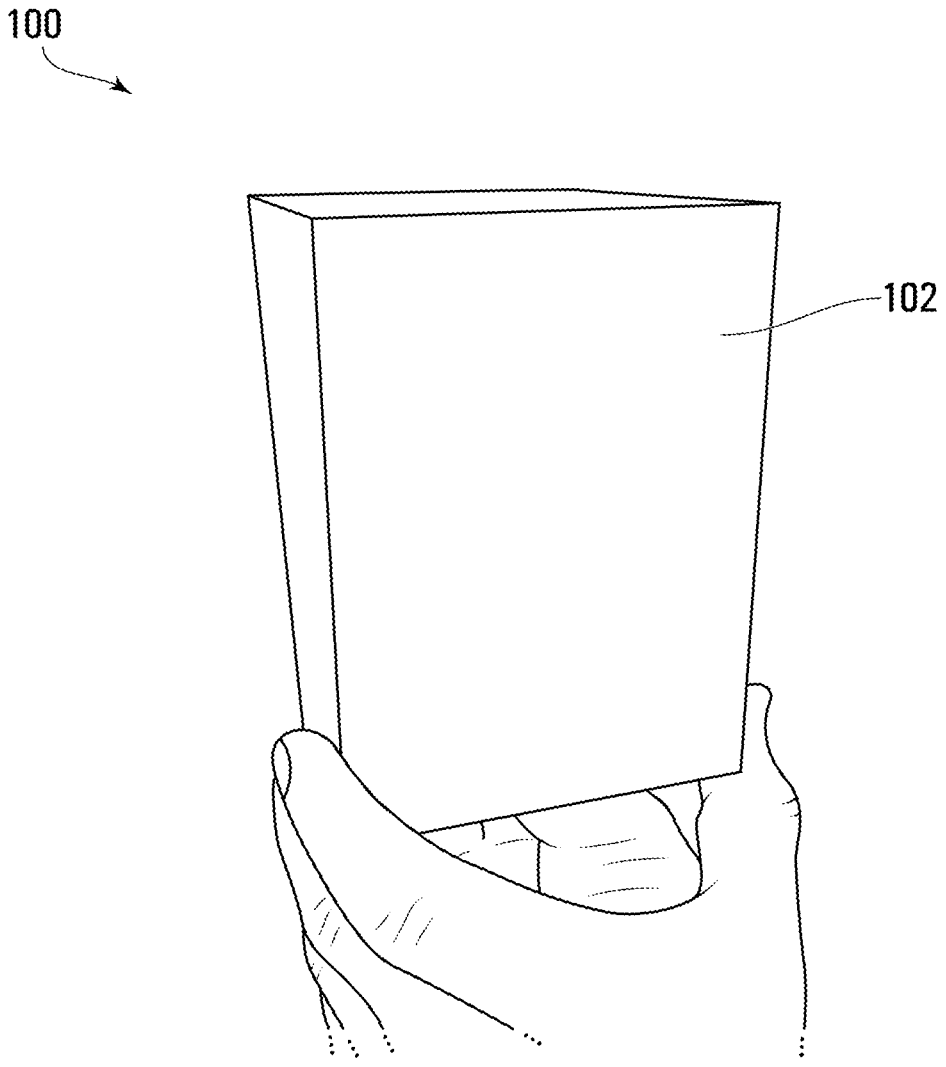
FIG. 8 is a perspective view of a toy assembly according to another non-limiting embodiment.

In the embodiment shown, the animation motor 66 is separate from the breakout motor 22, however in alternative embodiments the animation motor 66 is the same motor 22 and is configured to be able to rotate the toy character output member 38 and to move a portion of the toy character 14 relative to another portion of the toy character 14. FIG. 7 shows the toy character 14 after the animation motor 66 has been driven to move the front portion 14*a* of the toy character 14 to an upright position from a sitting position shown in FIG. 2. The sitting position may be considered a first position and the upright position may be considered a second position for the front portion 14*a* of the toy character 14. The toy character 14 may also be considered to be in a sitting position in FIG. 2 and in an upright position in FIG. 7.

In the example shown, the animation motor 66 is provided on the rear portion 14*b* and drives an animation motor pinion 68, which engages a sector 70 that is provided on the front portion 14*a*. The animation motor 66 may be a bidirectional electric motor and can be driven in one direction or the other to bring the front portion 14*a* to one or the other of the first and second positions. Any other suitable driving arrangement may alternatively be provided.

In the embodiment shown the breakout motor 22 may also be provided on the rear portion 14*b* of the toy character 14. Alternatively any other suitable structure may be provided.

It will be noted that the gear drive projection 36 may be on the toy character 14 instead of the shaft 34 and may thus be the toy character output member, and that the gear drive aperture 40 may be on a member that is on the shaft 34 instead of being on the toy character 14. Thus, it may be said that the toy character 14 is removably connected to the travel gear 28, via a non-round projection (i.e. projection 36) that is removably received in a non-round aperture (i.e. aperture 40).

In the embodiment shown the toy character 14 undergoes orbital movement to pull the tether 18 to open the hole 48. In another embodiment, the toy character 14 may undergo different movement in order to pull the tether 18 to open the hole 48. The toy character 14 may, for example, undergo rotational motion about an axis instead of orbital motion (i.e. such that the toy character 14 does not translate along an orbital path but instead rotates about its own axis).

Reference is made to FIGS. 8-15, which show another toy assembly at 100. The toy assembly 100 may be similar to the toy assembly 10, and includes a housing 102 and an inner object 104. The housing 102 may be similar to the housing 12. In the example shown in FIGS. 8-15, the housing 102 includes the fracture paths 16, and is substantially identical to the housing 12 except that the housing 102 includes a base 106 that is different than the base 24. The base 106 includes a first base portion 106*a* that has a breakout drive shaft 108 rotatably connected thereto. The breakout drive shaft 108 has a first end 110 with a handle 112 connected thereto outside of the housing 102, and a second end 114 with a drive gear 116 thereon. The base 106 further includes a second base portion 106*b* that has a travel gear 118 thereon and which has the inner object 104 thereon. In the example shown, the travel gear 118 is in the form of a ring gear that is integral with the second base portion 106*b* and may be molded therewith in embodiments where the second base portion 106*b* is molded.

The second base portion 106*b* is rotatably mounted to the first base portion 106*a* via a cylindrical projection 120 on the first base portion 106*a* that is received in a receptacle 122 on the second base portion 106*b*. The second base portion 106*b* is rotatable about an axis A. The axis A is a central axis of rotation for the ring gear 118.

The drive gear 116 is operatively engaged with the travel gear 118. In the present example, the operative engagement is via an intermediate gear 126 that is rotatably mounted to the first base portion 106*a*. As a result of the operative engagement, rotation of the breakout drive shaft 108 manually via the handle 112 drives rotation of the drive gear 116, which in turn drives movement of the travel gear 118, the second base portion 106*b* and the inner object 104 about the axis A.

Figure 9:
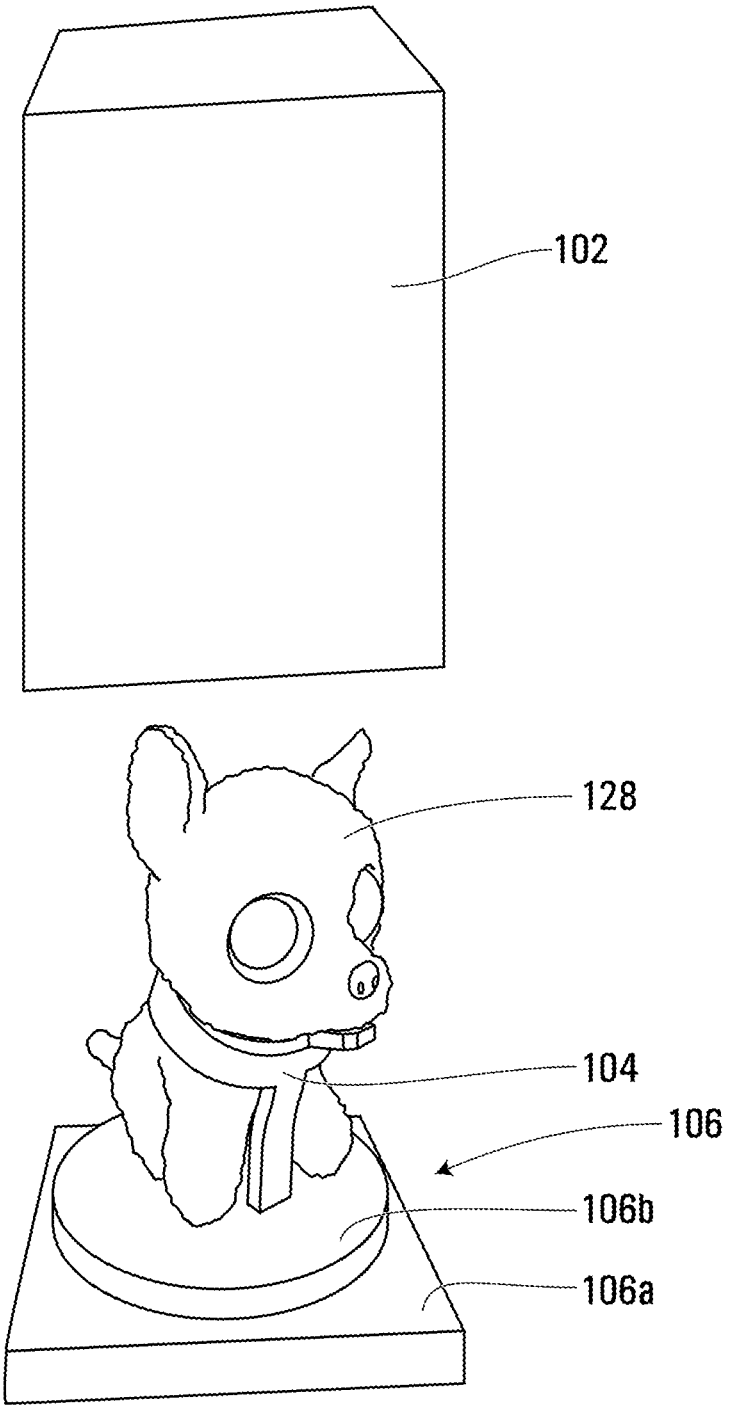
FIG. 9 is a perspective exploded view of the toy assembly shown in FIG. 8.
Figure 10:
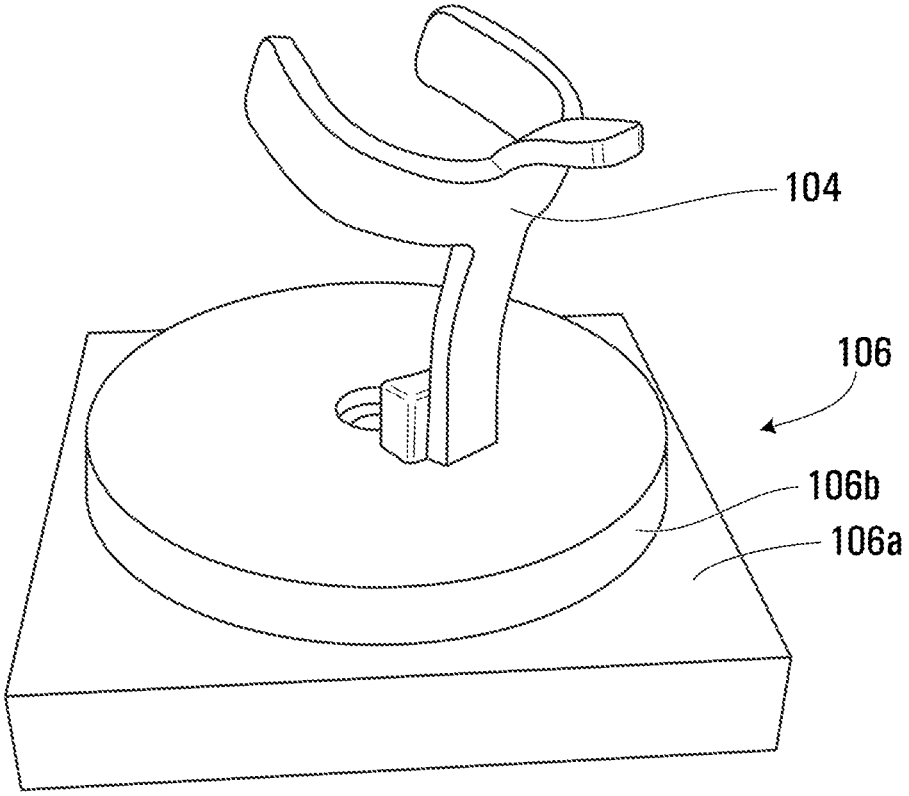
FIG. 10 is a perspective view of a base that is part of the toy assembly shown in FIG. 8.

The tether 18 connects the inner object 104 to the housing 102 in similar fashion to the tether 18 shown in the embodiment of FIGS. 1-7. However, the inner object 104 in FIGS. 8-13 differs in the sense that the inner object 104 is not itself a toy character. The inner object 104 is, in the present example, a support structure 127 that supports a toy character 128 (as shown in FIG. 9). The inner object 104 may be fixedly connected to the second base portion 106*b* and may not itself be intended for removal from the housing 102. The toy character 128, however, is removably mounted in the housing 102, and may simply sit within the support structure 127. By providing an inner object 104 which is separate from the toy character 128, the user of the toy assembly 100 does not have to remove the tether 18 from the toy character 128 when removing the toy character 128 from the housing 102 after operation of the breakout drive shaft 108 to open a hole (shown at 130 in FIGS. 13 and 14) in the housing 102.

The hole 130 is formed similarly to the hole 48 in the embodiment shown in FIGS. 1-7, which is by continued movement (e.g. rotation) of the inner object 103, which progressively pulls the tether shown at 132 (FIG. 15), which, in turn, pulls the strip shown at 134 from the housing 102.

As the toy character 14 travels along the travel path 42 it pulls the tether 18, which, in turn, pulls the strip 20, so as to open a hole (shown at 48 in FIG. 6C) in the housing 12.

Figure 11:
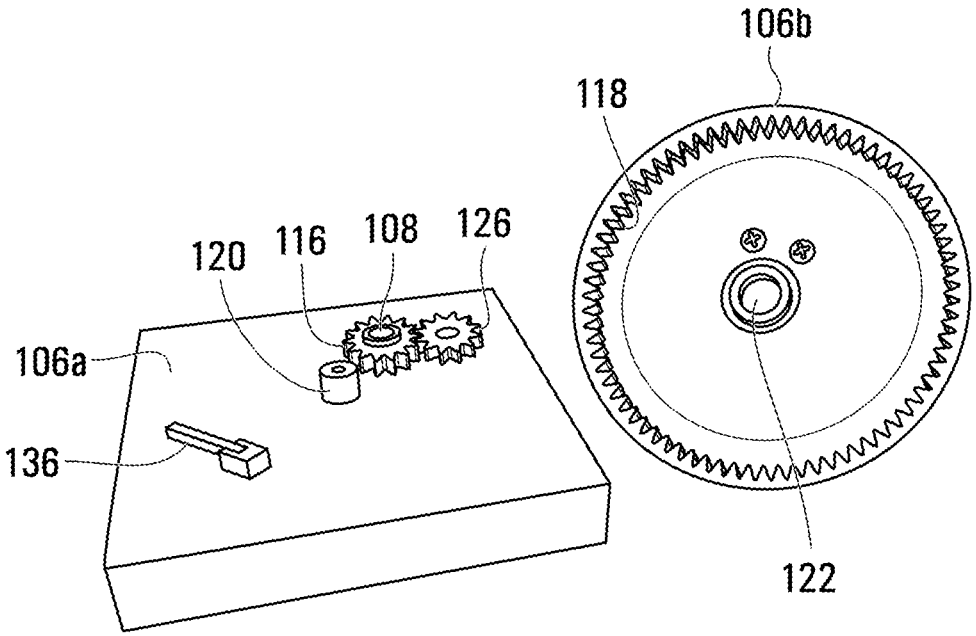
FIG. 11 is a perspective exploded view of the base shown in FIG. 10.
Figure 12:
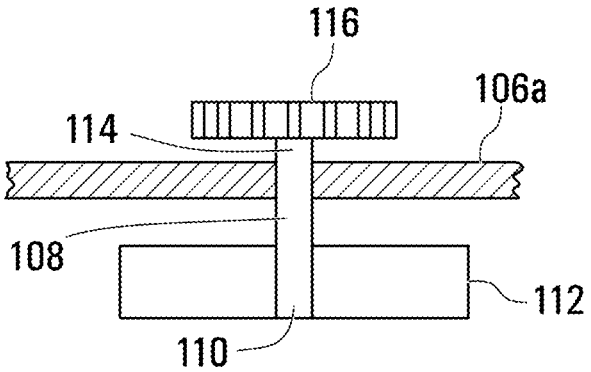
FIG. 12 is a sectional elevation view of a portion of the base shown in FIG. 10.
Figure 13:
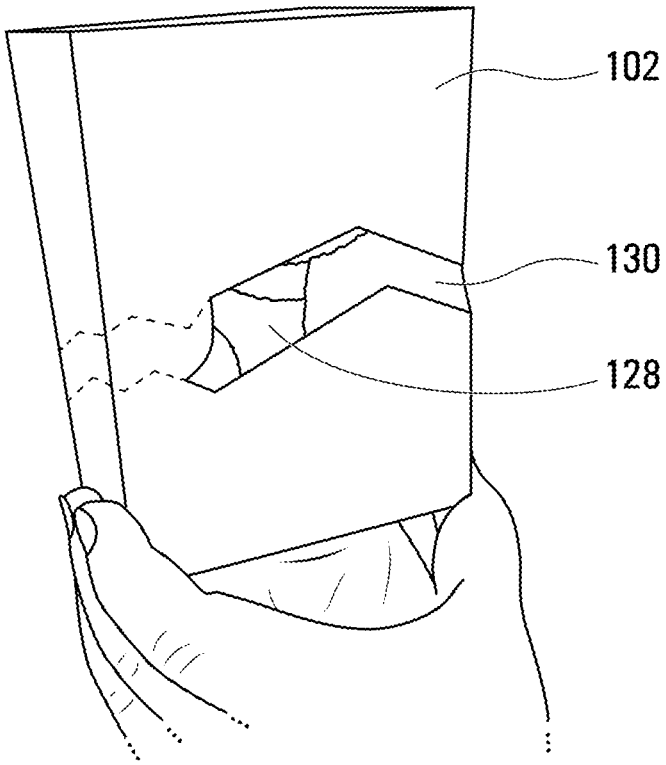
FIGS. 13 and 14 are perspective views that illustrate progressive tearing of a strip from the housing shown in FIG. 8.
Figure 14:
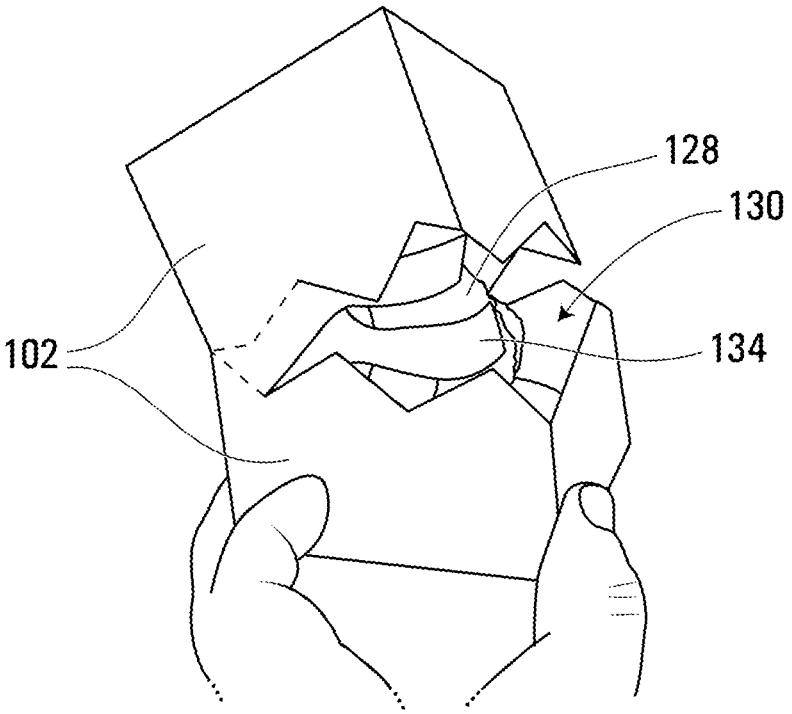
Figure 15:
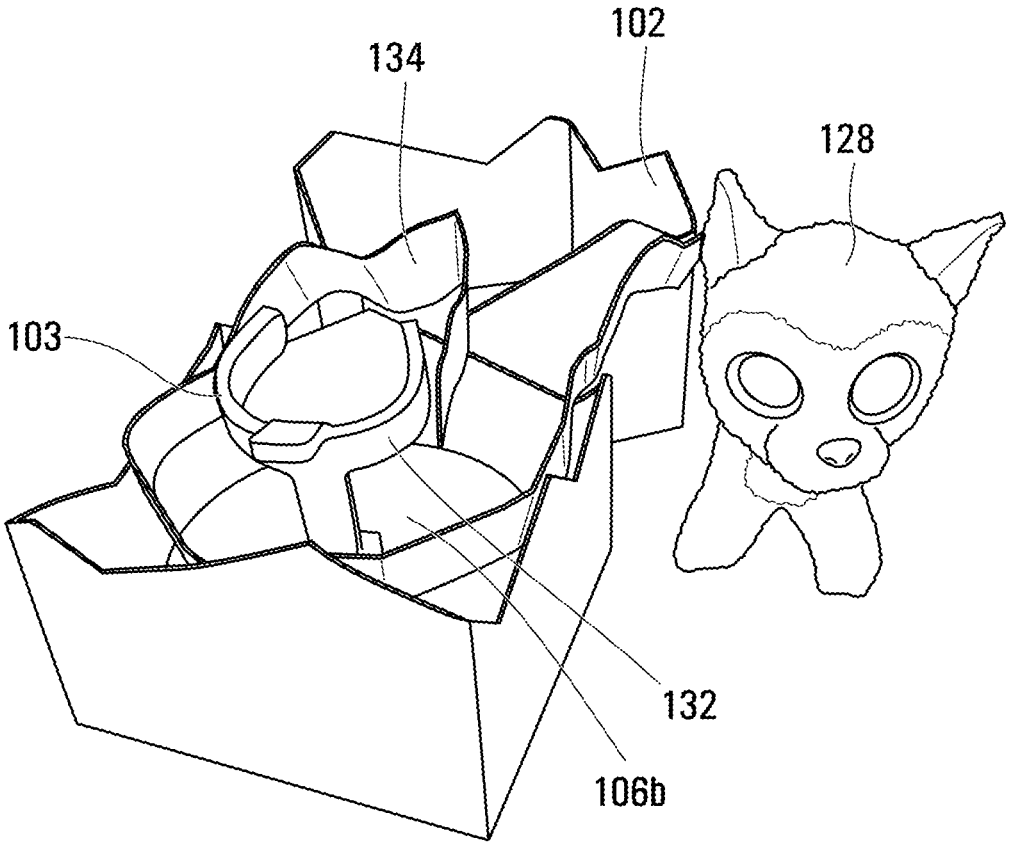
FIG. 15 is a perspective view of the toy assembly after removal of a toy character from the housing shown in FIG. 8.

A direction lock member shown at 136 in FIG. 11 may optionally be provided on the first base portion 106*a* to engage the teeth of the travel gear 118 at a sufficient angle to prevent the travel gear 118 from being rotated in one direction, while permitting the travel gear 118 to rotate in the opposite direction.

As a result of the operative connection between the drive gear 116 and the travel gear 118 on the second base portion 106*b*, which has the inner object 104 mounted thereto, it may be said that the breakout drive shaft 108 that is operatively connected to a portion of the inner object 104 to drive the inner object 104 to carry out movement (in the present case, rotation) inside the housing 102.

Persons skilled in the art will appreciate that there are yet more alternative implementations and modifications possible, and that the above examples are only illustrations of one or more implementations. The scope, therefore, is only to be limited by the claims appended hereto.

What is claimed is:

1. A toy assembly, comprising:

a housing having an outside surface, wherein the housing defines an interior space;

an inner object in the interior space of the housing;

a tether connected to the housing; and a breakout motor that is operatively connected to the inner object that is inside the housing, and wherein an end of the tether is connected to the inner object, thereby operatively connecting the breakout motor to the tether, such that operation of the breakout motor rotates the inner object, which pulls the tether, which in turn pulls a portion of the outside surface of the housing through into the interior space of the housing, thereby ripping a hole in the housing, wherein the inner object is in the form of a toy character and is sized to be removable from the housing through the hole.

2. A toy assembly as claimed in claim 1, wherein the housing is in the form of a box.

3. A toy assembly as claimed in claim 2, wherein the inner object is in the form of four-legged animal.

4. A toy assembly as claimed in claim 1, wherein the hole extends generally horizontally.

5. A toy assembly as claimed in claim 1, wherein the housing has a base including a first base portion that has a toothed travel path and wherein the inner object is connected to a travel gear that is engaged with the toothed travel path such that driving of the breakout motor drives the travel gear to roll along the toothed travel path, thereby driving the movement of the inner object inside the housing.

6. A toy assembly as claimed in claim 5, wherein the toothed travel path is in the form of a ring gear such that the inner object orbits a central axis of the ring gear.

7. A toy assembly as claimed in claim 5, wherein the travel gear is rotatably connected to a second base portion that is movably mounted to the first base portion and constrains the travel gear to remain engaged with the toothed travel path.

8. A toy assembly as claimed in claim 5, wherein the travel gear is rotatably connected to a second base portion that is itself rotatably mounted to the first base portion and constrains the travel gear to remain engaged with the toothed travel path, wherein the toothed travel path is in the form of a ring gear.

9. A toy assembly as claimed in claim 5, wherein the inner object is removably connected to the travel gear, via a non-round projection that is removably received in a non-round aperture.

10. A toy assembly as claimed in claim 1, wherein the housing includes a first preselected fracture path and a second preselected fracture path, wherein the tether is connected to a strip of the housing that is between the first and second fracture paths, such that pulling the tether rips the housing along the first and second fracture paths.

11. A toy assembly as claimed in claim 10, wherein each of the first and second fracture paths has a non-uniform zig-zag shape.

* * * * *